US005328013A

United States Patent [19]

Fuchs

[11] Patent Number: 5,328,013

[45] Date of Patent: Jul. 12, 1994

[54] LIMITATION OF THE LENGTH OF ROWS OF SUPERMARKET TROLLEYS

[76] Inventor: Peter Fuchs, Jahnstrasse 7, W-7300 Karlsruhe 1, Fed. Rep. of Germany

[21] Appl. No.: 978,224

[22] Filed: Nov. 19, 1992

[51] Int. Cl.[5] ..... G07F 7/06

[52] U.S. Cl. ..... 194/213; 194/905

[58] Field of Search ..... 194/205, 210, 213, 905

[56] References Cited

U.S. PATENT DOCUMENTS

| | | | |
|---|---|---|---|
| 4,572,347 | 2/1986 | Eisermann | 194/205 |
| 4,576,274 | 3/1986 | Thorsen | 194/905 X |
| 5,119,007 | 6/1992 | Lucas | 194/905 X |

FOREIGN PATENT DOCUMENTS

| | | | |
|---|---|---|---|
| 0070028 | 7/1982 | European Pat. Off. . | |
| 0231934 | 8/1988 | European Pat. Off. . | |
| 0301940 | 2/1989 | European Pat. Off. . | |
| 3436610A1 | 4/1985 | Fed. Rep. of Germany . | |
| 3900538A1 | 7/1990 | Fed. Rep. of Germany . | |
| 85/00961 | 3/1985 | World Int. Prop. O. | 194/905 |

*Primary Examiner*—F. J. Bartuska
*Attorney, Agent, or Firm*—Spensley Horn Jubas & Lubitz

[57] ABSTRACT

In a device for confining shopping carts, which is in the form of an accessory unit with control and locking devices (30, 40, 50) for known coin deposit systems (20) for one, an external permanent magnet as a control element (30) is disposed at the end of a shopping cart row which, when passing through the magnetic field (M), interacts with the locking elements (40, 50) of the coin deposit system (20) in such a way that it becomes possible to set up the operational states "Release" (ready to operate) or "Lock" (not ready to operate) exclusively. Therefore, with the appropriate disposition and size of these components there is operational readiness exclusively in the area of the shopping cart row. This contact-free interaction is easy to realize structurally and can be securely protected from third party intervention (FIG. 2).

19 Claims, 4 Drawing Sheets

LIMITATION OF THE LENGTH OF ROWS OF SUPERMARKET TROLLEYS

Figure 2:
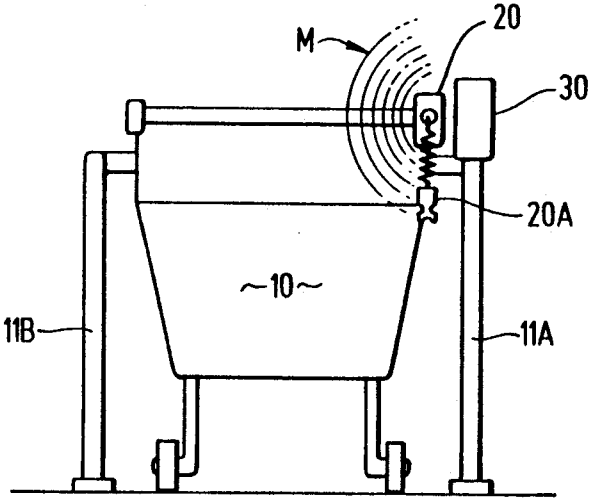

The invention relates to a device for confining shopping carts which have been pushed together in rows between lateral guide elements and which are used in connection with coin deposit systems, where the lateral guide elements on the one hand and each shopping cart on the other have cooperating control and locking elements which make possible the connection of a shopping cart with the row of shopping carts only if the shopping cart moves beyond a defined position (connecting position K) in the active area of the control and locking elements.

Such a device is known, for example from EP 0 433 751 A1, so that an explanation of the basic way of looking at the problems and of the problems connected therewith can be omitted here.

The known devices as well as EP 0 433 751 A1 exclusively disclose systems where the cooperating control and locking elements are mechanically designed, particularly in the form of pivot levers, locking bars and the like, which are disposed in the insertion and removal areas for the shopping carts, particularly on the lateral guide elements, and which, when a shopping cart is removed or added, are brought into a locked or released position by the carts themselves. Such systems have already been introduced into the market and satisfactorily meet the technical purpose of preventing the formation of too long shopping cart rows, however, they require a relatively large amount of mechanical efforts, in which trouble naturally plays a role which cannot be totally disregarded, and which furthermore can be put out of commission by the use of force (vandalism).

It is therefore the object of the invention to advance a device of the species further in such a way that it assures increased functional and operational reliability with smaller efforts and furthermore cannot be affected in its operation by unauthorized persons.

This object is attained in accordance with the invention in that the control elements are formed by at least one magnet and the locking elements can be brought into interaction with its magnetic field, where the magnet and the locking elements are disposed on the shopping cart and the guide elements and are placed there in such relative positions to each other that, when a shopping cart is moved within the field of action of the magnetic field, the locking elements can be moved between a locked position and a release position, and that the release position is only attained when the shopping cart reaches the connecting position K between the guide elements.

The essential difference with the known solution to these problems consists in that this is an interaction between the guide elements and locking elements which is free of connections and contacts, the mechanical action of the known solutions, which naturally must be accessible from the exterior, is replaced by the magnetic interaction between the control elements and locking elements with the help of a magnetic field.

Although different variants of the disposition and mutual effects of the control elements and locking elements on the basis of the principle of magnetic interaction are basically conceivable, a preferred embodiment of the invention consists in disposing the magnet on the lateral guide elements and the locking elements within the coin deposit systems which are passing through it in such a way, that when the coin deposit systems pass the magnet, its magnetic field controls the locking elements, depending on the position of the shopping cart, so that they are in the locked position or the release position. The disposition of the locking elements themselves it advantageously selected to be such that they directly or indirectly control the operation of the coin deposit system in the sense that the activation of the coin deposit system, i.e. particularly the return of a deposited coin when re-connecting the shopping cart to a shopping row, can only take place if it is possible to push the shopping cart far enough into the (not yet filled) shopping cart row that the locking elements of the coin deposit system permit the return of the deposited coin under the action of the magnetic field, for example in that a key provided by the adjoining shopping cart is inserted into the key slot of the coin deposit system and can release the coin there. However, it is possible in principle to integrate the locking elements in arbitrary forms and positions into the housing of the coin deposit system and the locking or release function can take place by the engagement of movable, conventional functional elements in adaptation to the individual type of the coin deposit system used.

The structural design of the locking elements themselves and the concept of the two positions required of it, namely locking and release positions, consists in the simplest case by providing a course of movement of a functional part, the two end positions of which then respectively define the locking and release positions. These can be pivot movements, for example over a predetermined area of an angle, but also displacement or combined pivot-displacement movements, provided that the component used can perform (under the influence of the magnetic field) the respective locking and release function in the two definitely attainable end positions. Various structural solutions can be used for this, for example balls, shafts, lift cylinders, pivot arms and the like, without it being necessary to make an exhaustive list of these.

A permanent magnet or an electromagnet can be used here, the latter may have the advantage under certain circumstances that the entire system can be deactivated by disconnecting the current supply.

Figure 1:
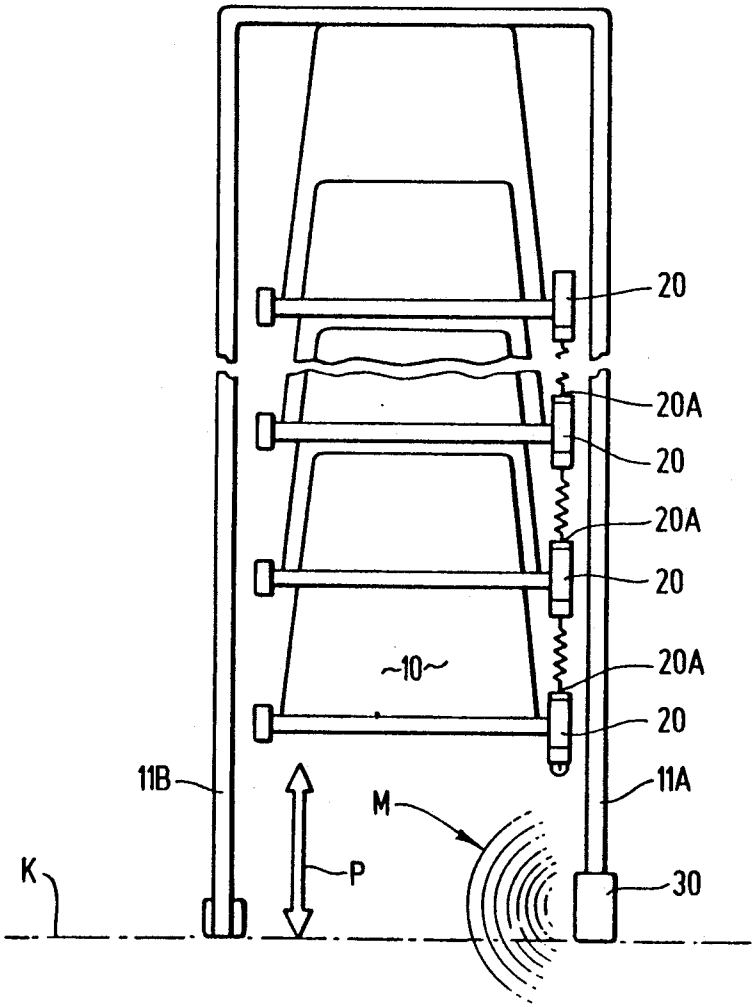
Figure 4:
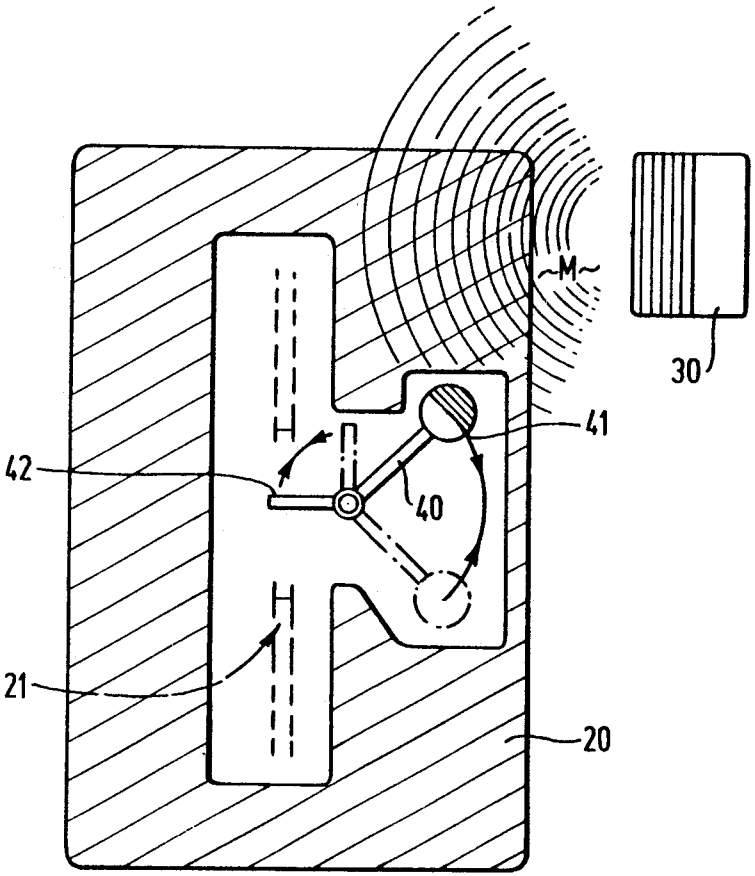
Figure 3:
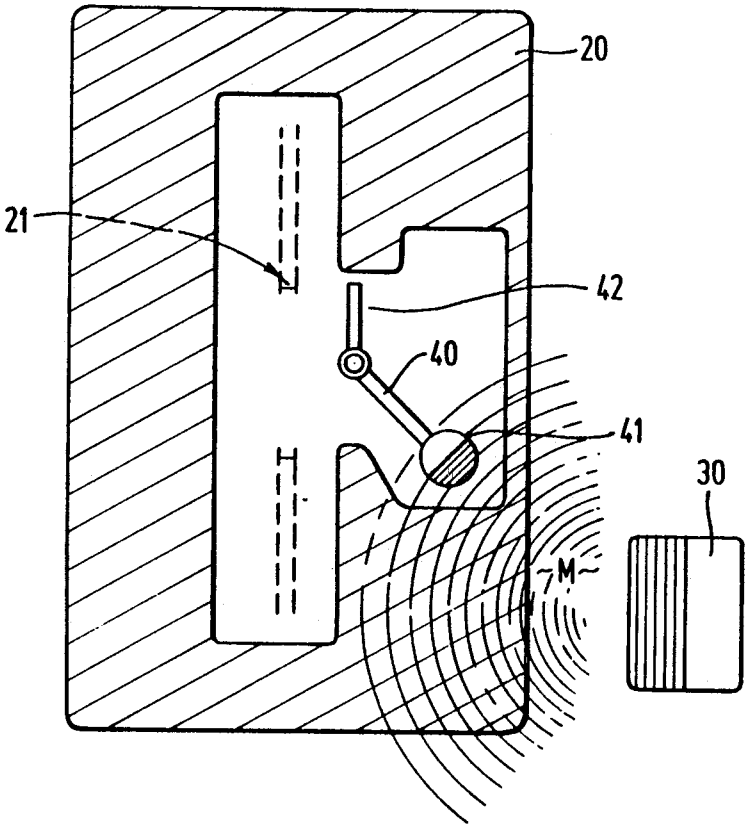
Figure 5B:
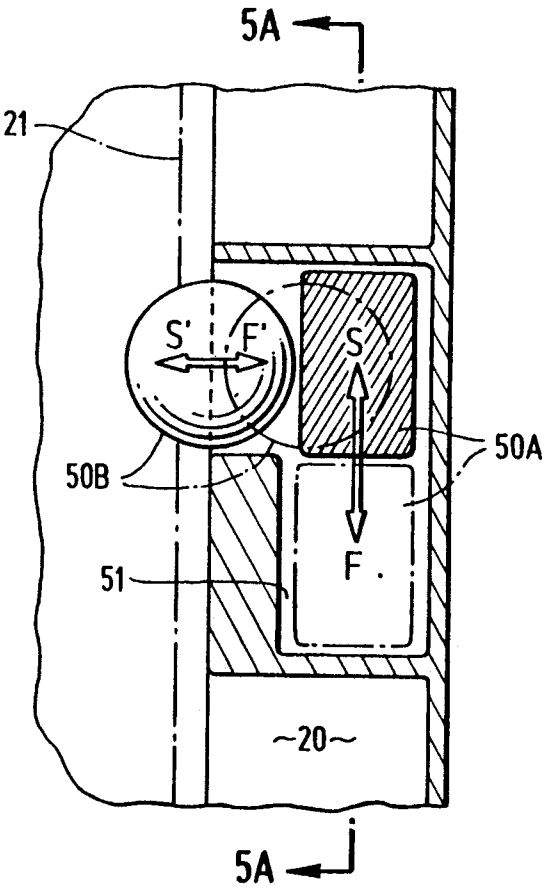
Figure 5A:
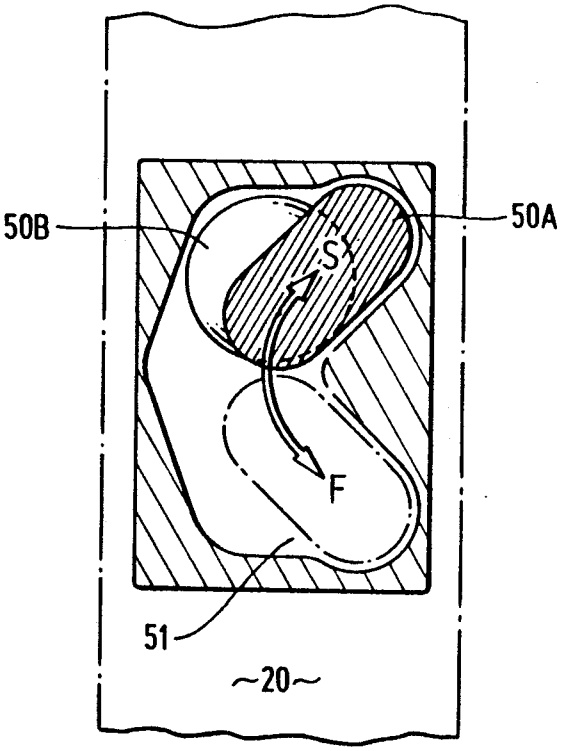
Figure 6:
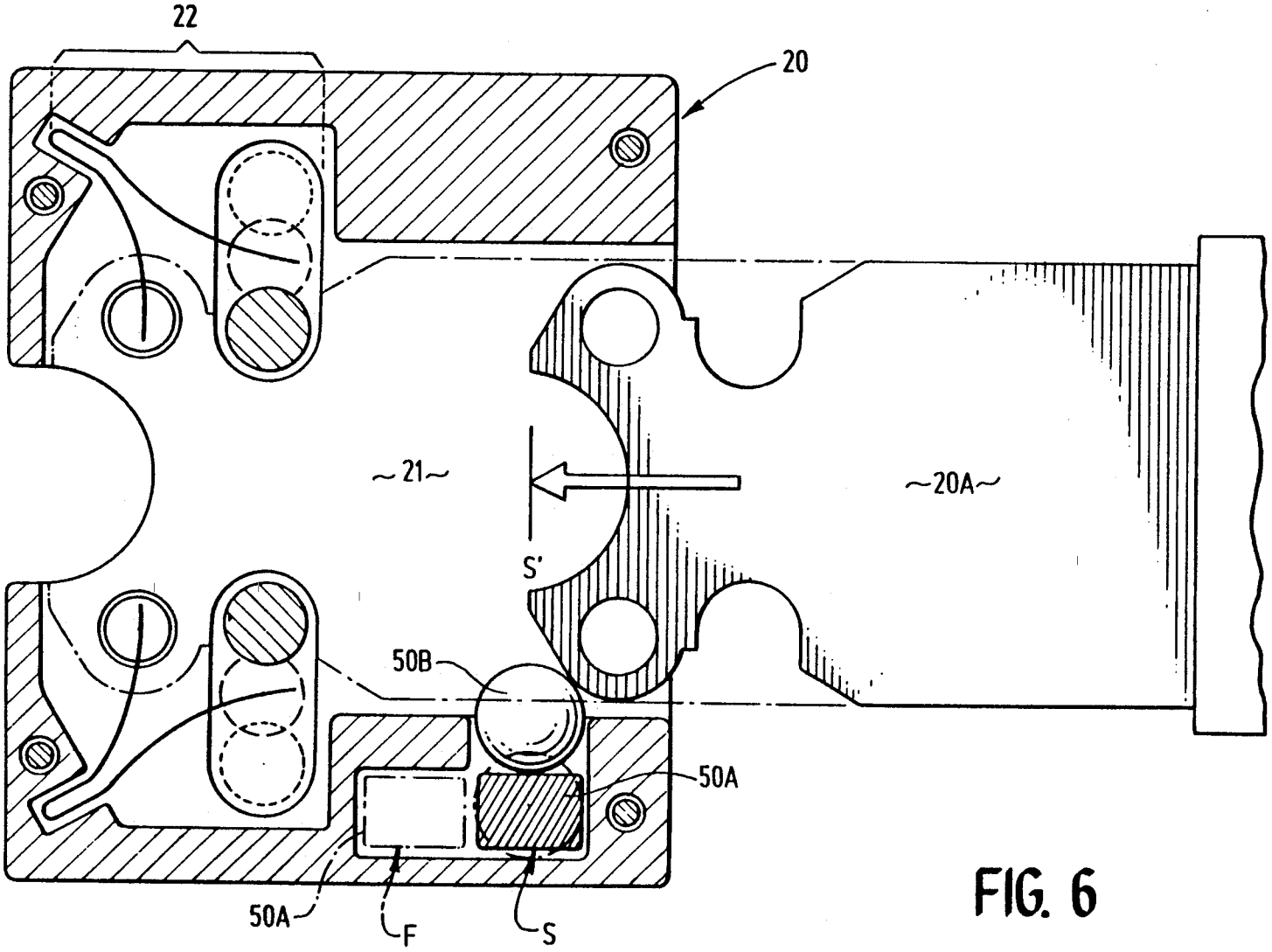

Further embodiments can be found in the dependent claims, exemplary embodiments of the device in accordance with the invention will be explained by means of the drawings, which show in:

FIGS. 1 and 2 a schematic view of a shopping cart row in a top view and a front view with the device of the invention, FIGS. 3 and 4 a view in principle of the design of a control element in cooperation with a magnet, FIGS. 5A and 5B two sectional views of a second variant of a locking element, and FIG. 6 the employment in a coin deposit system of a locking element in accordance with FIGS. 5A and B.

FIGS. 1 and 2 show a top view and a front view of a shopping cart row consisting of a plurality of shopping carts 10, which are connected with each other between lateral guide elements 11A, 11B, for which purpose it is required in connection with the illustrated exemplary embodiment to insert the keys 20A of coin deposit systems 20 disposed on the side of the handle into the respectively adjoining coin deposit system 20 in order to retrieve the deposited coin or, conversely, to insert a coin as a deposit for pulling out the associated key and to release the shopping cart for removal out of the row.

In this connection it is desirable that this operation is assured only if the last shopping cart 10 has attained a connecting position K within the area between the lateral guide elements 11A, 11B, i.e. if re-connection with return of the deposited coin can only be achieved in this position. To attain this, the invention provides that a magnet 30 is disposed at the same height with the coin deposit system 20 and on the lateral guide element 11A immediately adjacent to it, the magnetic field M of which is sufficiently strong to charge components in the coin deposit system 20 responding to magnetic interaction in such a way that they act as locking elements, i.e. that as a function of the position of the respective coin deposit system 20 in relation to the magnet 30 or to its magnetic field M, these locking elements selectively control these operations. For this purpose the locking elements and their interaction with the magnetic field M should be designed in such a way that their release position (i.e. return of the deposited coin when reconnecting) is only attained if the shopping cart 10 is located back of the connecting position K, therefore in the desired position between the two lateral guide elements 11A, 11B. During the passage of a shopping cart 10 (two-headed arrow P in FIG. 1) through the magnetic field M, a switching operation within the passing coin deposit system, depending on the direction of the passage, is therefore triggered, the result of which is that the coin deposit system is only in the release position if the associated shopping cart is correctly located within the shopping cart row and back of the connecting position K, but that in all other positions outside of this area the coin deposit system is deactivated by the magnetically operating locking elements.

The mode of operation of the magnetic field is shown in detail by curved lines in the drawings, but this has nothing to do with the actual field lines present and their extent, these are naturally dependent on the shape and strength of the magnets used and on the locking element employed.

FIGS. 3 and 4 show how this principle is to be realized, where FIG. 3 represents the release position and FIG. 4 the locking position:

Only the components essential to the invention have been shown here by means of a rough example for reasons of simplicity: A slot 21 is located in the interior of the coin deposit system 20, through which, for example, the coin itself or the key 20A can be inserted and/or removed and the coin deposit system operated in this way. As defined, this operation is intended to be either prevented (shopping cart outside of the connecting position) or permitted (shopping cart back of the connecting line K), as described above. For this purpose a locking element in the form of a toggle switch 40 with an axis of rotation perpendicularly to the drawing plane is seated pivotably over an angular area of approximately 90° in such a way that in the release position (FIG. 3) its one end 42 does not block the slot 21, but in the locking position (FIG. 4) extends into the slot 21 and blocks the insertion of a key or a coin through this slot. To attain this, the other end 41 of the toggle switch 40 is itself provided with a magnet, for example, which enters into a respective interaction with the magnetic field M of the stationary magnet 30 where, in the exemplary embodiment illustrated, the two magnets attract each other to attain the desired operation. It is also simply conceivable that under these conditions, when the coin deposit system 20 is displaced in the drawing plane from the release position of FIG. 3 into the locked position of FIG. 4, the toggle switch 40, attracted by the magnet 30, makes this 90° pivot movement from releasing the slot 21 to its blocking, i.e. exactly at the time when the shopping cart which is part of this coin deposit system passes the magnet 30 in the area of the connecting position K.

FIG. 5 shows a second exemplary embodiment of a realization of a locking element, but the illustration of the magnet has been omitted here:

A first magnetic locking element 50A of elongated shape and rounded at the ends is disposed in a V-shaped guide channel 51 in such a way, that under the effect of the magnetic field M it can realize its two "switch positions" by sliding back and forth in this guide channel 51 in the direction of the arrows shown, where the position shown shaded in FIG. 5 is intended to show the locking position S and the position enclosed in dashed lines the release position F. In contrast to the example of the principle in FIGS. 3 and 4, the magnetically sensitive first locking element 50A does not directly act on an operational component of the coin deposit system 20, but a second (as a rule non-magnetic) locking element 50B, which is in the form of a ball in the exemplary embodiment, where this action is such that in the release position F of the first magnetic locking element 50A, the second locking element 50B can also be in a release position F' (therefore does not extend into the slot 21) while, when the first magnetic locking element 50A is switched under the effect of the magnetic field M into its locking position S, because of the corresponding mechanical action the second locking element 50B, the ball, is pushed out into a locking position S' where it then can affect suitable operational components of the coin deposit system in the desired sense of locking them.

Finally, FIG. 6 illustrates a concrete use of such an exemplary embodiment in accordance with FIG. 5:

A longitudinal section through a conventional coin deposit system 20 (coin-operated lock) is shown, where the key 20A of the adjoining coin-operated lock must be inserted into the key slot 21, where in its end position the key 20A actuates locking devices 22 which release the deposited coin in particular, so that it can be removed in the withdrawal area E. These locking devices 22 are conventionally embodied with the aid of locking bars, springs and the like and need not be further discussed here. It is important that the two locking elements 50A, 50B are disposed in the inlet area of the guide slot 21, in FIG. 6 in their locking position. It becomes immediately clear that because of the second locking element 50B extending into the key slot 21 ,the diameter of the key slot is sufficiently reduced so that the key 20A can no longer be completely inserted into the key slot 21 and instead abuts against the second locking element 50B in the illustrated locking position S. Thus the key 20A no longer can actuate the locking device 22 to release the coin and it follows from this that the removal of the deposited coin from the coin-operated lock is assuredly prevented outside of the desired connecting position within the lateral guide elements 11A, 11B. Only if, under the influence of the magnetic field M, the coin-operated lock 20 has again been placed into the permissible connecting position, the magnetic locking element 50A again takes up its release position F (FIG. 5), and the second locking element 50A then can be pushed back by the effect of the front shoulder of the key 20A into the free space provided for it in the housing of the coin-operated lock. Subsequently the key can be pushed ahead into its forward position indicated by dashed lines, can activate the locking device 22 for the coin, which can then be taken from the coin-operated lock.

I claim:

1. A device for confining shopping carts (10) which are pushed together in a row between lateral guide elements (11A, 11B), the lateral guide elements (11A, 11B) defining a cart storage area, which has a connecting location (K), said device comprising:

a plurality of coin deposit systems (20) each mounted on a respective cart (10); and control and locking means (30, 40 50) mounted on the carts (10) and on at least one guide element (11A, 11B) for connecting a first cart (10) to a second cart (10) which is already in the cart storage area when the first cart (10) moves past the connecting location (K0 and into the cart storage area, wherein said control and locking means (30, 40 50) comprise at least one magnet (30) which produces a magnetic field (M) and a plurality of locking elements (40, 50) each associated with a respective coin deposit system (20);

each said locking element (40, 50) is movable between a locking position for retaining a coin previously deposited in the associated coin deposit system (20) and a release position for releasing a coin previously deposited in the associated coin deposit system (20); and each said locking element (40, 50) is mounted to move through the magnetic field (M) produced by said magnet (30) when the cart (10) on which an associated coin deposit system (20) is mounted moves past the connecting location (K), and each said locking element (40, 50) is responsive to the magnetic field (M) for movement between the locking and release positions and for movement to the release position only when the cart (10) on which the associated coin deposit system (20) is mounted moves past the connecting location (K) and into the cart storage area.

2. A device in accordance with claim 1, characterized in that the magnet (30) is a permanent magnet.

3. A device in accordance with claim 1, characterized in that the magnet (30) is an electromagnet.

4. A device in accordance with claim 1, characterized in that the magnet (30) is disposed stationary in the entry area of the guide elements (11A, 11B) and placed so that it can be adapted to the position of the coin deposit systems (20) of the shopping carts (10), and that the locking elements (30, 40, 50) engage in the operation of the coin deposit systems (20).

5. A device in accordance with claim 1, characterized in that each said locking element is provided as a toggle switch (40) of at least partially ferromagnetic material, and that the toggle switch (40) is maintained freely movable between the release position and the locking position in the housing of the coin deposit system (20) under the effect of the magnetic field (M).

6. A device in accordance with claim 1, characterized in that each said locking element comprises a first magnetic locking member (50A) displaceable in a guide channel (51) which is under the effect of the magnetic field (M), where the guide channel (51) defines the release position (F) and the locking position (S).

7. A device in accordance with claim 1, characterized in that in its locking position each said locking element (40, 50A, 50B) blocks those parts (21) of the coin deposit system (20) which control the coin return.

8. A device in accordance with claim 5, characterized in that in its locking position each said locking element (40, 50A, 50B) blocks those parts (21) of the coin deposit system (20) which control the coin return.

9. A device in accordance with claim 6, characterized in that in its locking position each said locking element (40, 50A, 50B) blocks those parts (21) of the coin deposit system (20) which control the coin return.

10. A device in accordance with claim 6 wherein each said locking element (50) further comprises a second locking member (50B) separate from said first locking member (50A), and said first locking member (50A) in the course of its displacement acts on said second locking member (50B).

11. A device in accordance with claim 10, characterized in that in its locking position each said locking element (40, 50A, 50B) blocks those parts (21) of the coin deposit system (20) which control the coin return.

12. A device in accordance with claim 7 wherein each said coin deposit system (20) has a key slot (21) constituting a passage having a cross section for receiving a key, and a coin slot for receiving a coin and means (22) for locking a coin received in the coin slot, and when said locking element (50) associated with a said coin deposit system is in the locking position, the cross section of the key slot is reduced to prevent insertion of a key as far as said coin slot.

13. A device in accordance with claim 7 wherein each said coin deposit system has a coin slot for receiving a coin, and when said locking element associated with a said coin deposit system is in the locking position, it directly blocks said coin slot.

14. A device in accordance with claim 8 wherein each said coin deposit system (20) has a key slot (21) constituting a passage having a cross section for receiving a key, and a coin slot for receiving a coin and means (22) for locking a coin received in the coin slot, and when said locking element (50) associated with a said coin deposit system is in the locking position, the cross section of the key slot is reduced to prevent insertion of a key as far as said coin slot.

15. A device in accordance with claim 8 wherein each said coin deposit system has a coin slot for receiving a coin, and when said locking element associated with a said coin deposit system is in the locking position, it directly blocks said coin slot.

16. A device in accordance with claim 9 wherein each said coin deposit system (20) has a key slot (21) constituting a passage having a cross section for receiving a key, and a coin slot for receiving a coin and means (22) for locking a coin received in the coin slot, and when said locking element (50) associated with a said coin deposit system is in the locking position, the cross section of the key slot is reduced to prevent insertion of a key as far as said coin slot.

17. A device in accordance with claim 9 wherein each said coin deposit system has a coin slot for receiving a coin, and when said locking element associated with a said coin deposit system is in the locking position, it directly blocks said coin slot.

18. A device in accordance with claim 11 wherein each said coin deposit system (20) has a key slot (21) constituting a passage having a cross section for receiving a key, and a coin slot for receiving a coin and means (22) for locking a coin received in the coin slot, and when said locking element (50) associated with a said coin deposit system is in the locking position, the cross section of the key slot is reduced to prevent insertion of a key as far as said coin slot.

19. A device in accordance with claim 11 wherein each said coin deposit system has a coin slot for receiving a coin, and when said locking element associated with a said coin deposit system is in the locking position, it directly blocks said coin slot.

* * * * *